US007712870B2

(12) United States Patent
Shibata et al.

(10) Patent No.: US 7,712,870 B2
(45) Date of Patent: May 11, 2010

(54) INK JET RECORDING HEAD WITH SEALANT FILLING REGION IN SUBSTRATE

(75) Inventors: Takeshi Shibata, Yokohama (JP); Hiroki Tajima, Yokohama (JP); Toru Kanda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 433 days.

(21) Appl. No.: 11/741,891

(22) Filed: Apr. 30, 2007

(65) Prior Publication Data

US 2007/0285465 A1 Dec. 13, 2007

(30) Foreign Application Priority Data

May 16, 2006 (JP) ..... 2006-136702

(51) Int. Cl.
*B41J 2/14* (2006.01)
*B41J 2/16* (2006.01)

(52) U.S. Cl. ..... 347/50; 347/58

(58) Field of Classification Search ..... 347/20, 347/40, 44, 47, 49, 50, 56–59
See application file for complete search history.

(56) References Cited

U.S. PATENT DOCUMENTS 5,748,213 A 5/1998 Karita et al.
5,826,333 A 10/1998 Iketani et al.
6,257,703 B1 7/2001 Hirosawa et al. ..... 347/50
6,331,051 B1 12/2001 Tajima et al.
6,626,514 B2 9/2003 Tajima et al.
6,652,062 B2 11/2003 Umeyama et al.
6,659,591 B2 12/2003 Sato et al. ..... 347/50
6,799,841 B2 10/2004 Iri et al.
6,935,726 B2 * 8/2005 Watanabe ..... 347/58
2005/0078143 A1 4/2005 Shimomura
2007/0008378 A1 1/2007 Kanda

FOREIGN PATENT DOCUMENTS

JP 10-44420 2/1998
JP 2002-19119 1/2002

* cited by examiner

*Primary Examiner*—Juanita D Stephens
(74) *Attorney, Agent, or Firm*—Fitzpatrick, Cella, Harper & Scinto

(57) ABSTRACT

To provide an ink jet recording head, by which a recording operation with a high recording quality can be performed without causing deformation or breakage of a recording element substrate and the manufacture cost is reduced, a filling groove filled with sealant for protecting a recording element substrate from ink includes a salient or divider.

8 Claims, 11 Drawing Sheets

TOP FACE

BACK FACE

INK JET RECORDING HEAD WITH SEALANT FILLING REGION IN SUBSTRATE

BACKGROUND OF THE INVENTION

1. Field of the Invention

The present invention relates to an ink jet recording head used for a recording apparatus in which recording liquid (e.g., ink) is discharged from a discharge opening to form ink droplets for a recording operation.

2. Description of the Related Art

A general ink jet recording cartridge will be described with reference to FIG. 10. The following section will exemplarily describe a color cartridge from which yellow, magenta, and cyan inks are discharged for a printing operation.

In FIG. 10, an ink jet recording cartridge 601 is structured by integrating an ink jet recording head section including a recording element substrate 702 made of silicon for example and an ink container section 709 including therein ink. The recording element substrate 702 is a heater for allowing ink to be discharged by conversion of electrical energy to thermal energy. The recording element substrate 702 is composed by a nozzle plate that includes: a substrate including a wiring for transmitting electrical energy supplied from an ink jet recording apparatus to the heater; a flow path for supplying ink to the heater; and a plurality of ink discharge openings for discharging ink. One recording element substrate 702 includes discharge opening rows 703, 704, and 705 for discharging ink of three colors of yellow, magenta, and cyan. The electric wiring substrate 706 functions to transmit an electric signal from the ink jet recording apparatus to the recording element substrate 702 by transmitting an electric signal from the ink jet recording apparatus to the recording element substrate 702 via an external signal input terminal 707. The electric wiring substrate 706 is electrically connected to the recording element substrate 702 at two end faces of the recording element substrate 702 so that the electric connection section is covered by sealant 708 for protection from ink.

Next, the general structure of the periphery of the recording element substrate 702 in the ink jet recording head section will be described with reference to FIG. 11 and FIG. 12.

FIG. 11 is a plan view illustrating a support substrate 802 and a support plate 804. The support substrate 802 is made of material such as alumina in order to accurately adhere and fix the recording element substrate 702 and is subjected to a polishing processing. The support plate 804 fixes and supports the electric wiring substrate 706 and is made of the same material as that of the support substrate 802.

FIG. 12 is a cross-sectional view taken along a line XII-XII of FIG. 10. The support substrate 802 includes an ink supply opening 803 for supplying ink in an ink container to the recording element substrate 702. The recording element substrate 702 is attached so that the ink supply opening 803 communicates with the ink supply opening of the recording element substrate 702. A support plate 804 is also attached in order to support the recording element substrate 702. A space between the recording element substrate 702 and the support plate 804 is sealed by sealant 805 (e.g., resin) in order to prevent ink from entering the space. The purpose of this sealing is to prevent, when ink enters the space between the recording element substrate 702 and the support plate 804 and is attached to an end of a side face of the recording element substrate 702, silicon exposed at the end of the side face of the recording element substrate 702 from being eluted and to protect the electric connection section from ink. This sealant 805 is generally thermosetting resin that can be used in a manufacture step in a relatively easy manner.

An accuracy at which the recording element substrate 702 is attached has a direct influence on a recording accuracy of the ink jet recording apparatus. To improve the attachment accuracy or to realize a manufacture step having a high yield, various suggestions have been conventionally made. Japanese Patent Laid-Open No. H10-44420 has proposed that a recording element substrate is fixed by adhering a support substrate having substantially the same thermal characteristic as that of the recording element substrate is adhered to the recording element substrate. Japanese Patent Laid-Open No. 2002-19119 has proposed a method for preventing a recording element substrate from being broken due to different line coefficients of expansion, by adhering a support substrate made of alumina for example between the recording element substrate and the support member.

Cost for a recording element substrate is the highest cost among manufacturing costs for an ink jet recording head. In order to reduce the cost for the recording element substrate, a demand has been recently raised to minimize the size of the recording element substrate so that more recording element substrates can be obtained from one wafer. However, when the substrate size is reduced while leaving the discharge opening arrangement unchanged, a wall section around the discharge opening is reduced, resulting in a wall section having a poor rigidity in the recording element substrate. Since the periphery of the recording element substrate is sealed by the thermosetting resin as described above, the thermosetting resin generates therein, when the thermosetting resin cures and shrinks, a stress that is applied to the recording element substrate. The following section will describe the outline of the stress that is caused when the sealant cures and shrinks and that is applied to the recording element substrate.

FIG. 13 illustrates the stress in the sealant 805 applied to the recording element substrate 702. When a recording head is manufactured, the recording element substrate 702, the support plate 804, and the support substrate 802 and adhesive agent and sealant for fixing them are placed in an oven heated at 100 degrees. Then, the respective members expand by heat and cure while expanding. The respective members have different expansion rates depending on the materials thereof. When the respective cured members are taken out from the oven, the temperatures of the respective members decline to a room temperature and thus the shapes of the expanded members return to the original shapes. It is known that general thermosetting sealant cures and shrinks by about 5%. Thus, stresses shown by arrows in FIG. 13 are caused in the sealant 805 due to the curing and shrinkage of the respective members and the changes with a temperature of the respective members. The opposite side face of the recording element substrate 702 is also in the same condition, although FIG. 13 illustrates only a part of the ink jet recording head and thus does not show the condition of the opposite side face. Specifically, a force from the side face to outside is applied to the recording element substrate 702. When the stress as described above is applied to the recording element substrate 702 as described above, a sectional area at which the recording element substrate 702 has a contact with the sealant 805 is small as shown in FIG. 12 and thus tends to deform when being applied with the stress. Furthermore, the recording element substrate 702 has different opening spaces at a face having a contact with the support substrate 802 and a face opposed to the face. Thus, when the sealant 805 applies a force to the recording element substrate 702, the recording element substrate 702 may deform while having warpage. When a recording head using such a deformed recording element substrate 702 is used for a recording operation, ink droplets discharged from the recording head of an ink jet recording apparatus adhere to a paper in a dislocated manner, thus causing a deteriorated recording quality. Furthermore, the recording element substrate 702 may be broken in a manufacture process.

When the electric wiring substrate 706 and the support plate 804 for supporting the electric wiring substrate 706 from the lower side that respectively have opening sections are adhered by adhesive agent so that the opening sections of the former and the latter are superposed on the other hand, excessive adhesive agent may protrude from an end of the joint face of the joined opening sections. When this protruded adhesive agent moves from the end face of the electric wiring substrate to reach the upper surface, an inconvenience such as a favorable electric joint of the electric joint section or a contact of the electric joint section with a recording medium may be caused. In order to prevent this, the electric wiring substrate 706 has an opening smaller than an opening of the support plate 804. This causes adhesive agent protruding from the end face of the joint section to go down to the interior of the opening section of the support plate 804, thus preventing the adhesive agent from reaching the upper surface of the electric wiring substrate 706.

Another requirement has been made according to which a needle for coating adhesive agent desirably does not have a small inner diameter from the viewpoint of a manufacture efficiency. The present invention has been made in view of the above problems. It is an objective of the present invention to provide an ink jet recording head by which a recording operation having a high recording quality can be stably performed without causing deformation or breakage of the recording element substrate 702 and the manufacture cost is low.

SUMMARY OF THE INVENTION

According to one aspect of the present invention, an ink jet recording head comprises a recording element substrate including a discharge opening row for discharging ink; and a support substrate that has a support section for supporting the recording element substrate and that has a sealant filling region adjacent to the support section, wherein the filling region is divided, by a divider, to a filling region adjacent to the recording element substrate and a filling region away from the recording element substrate.

In the ink jet recording head of the present invention, a sealant filling groove for protecting a substrate from ink includes a salient. The existence of this salient can reduce the volume of filler to reduce the stress caused by the curing and shrinkage of the filler to reduce the influence by the stress on the recording element substrate, thereby realizing an ink jet recording head that can provide a recording operation with a high recording quality.

Further features of the present invention will become apparent from the following description of exemplary embodiments (with reference to the attached drawings).

DESCRIPTION OF THE EMBODIMENTS

First Embodiment

Hereinafter, an embodiment of the present invention will be described in detail.

Figure 1:
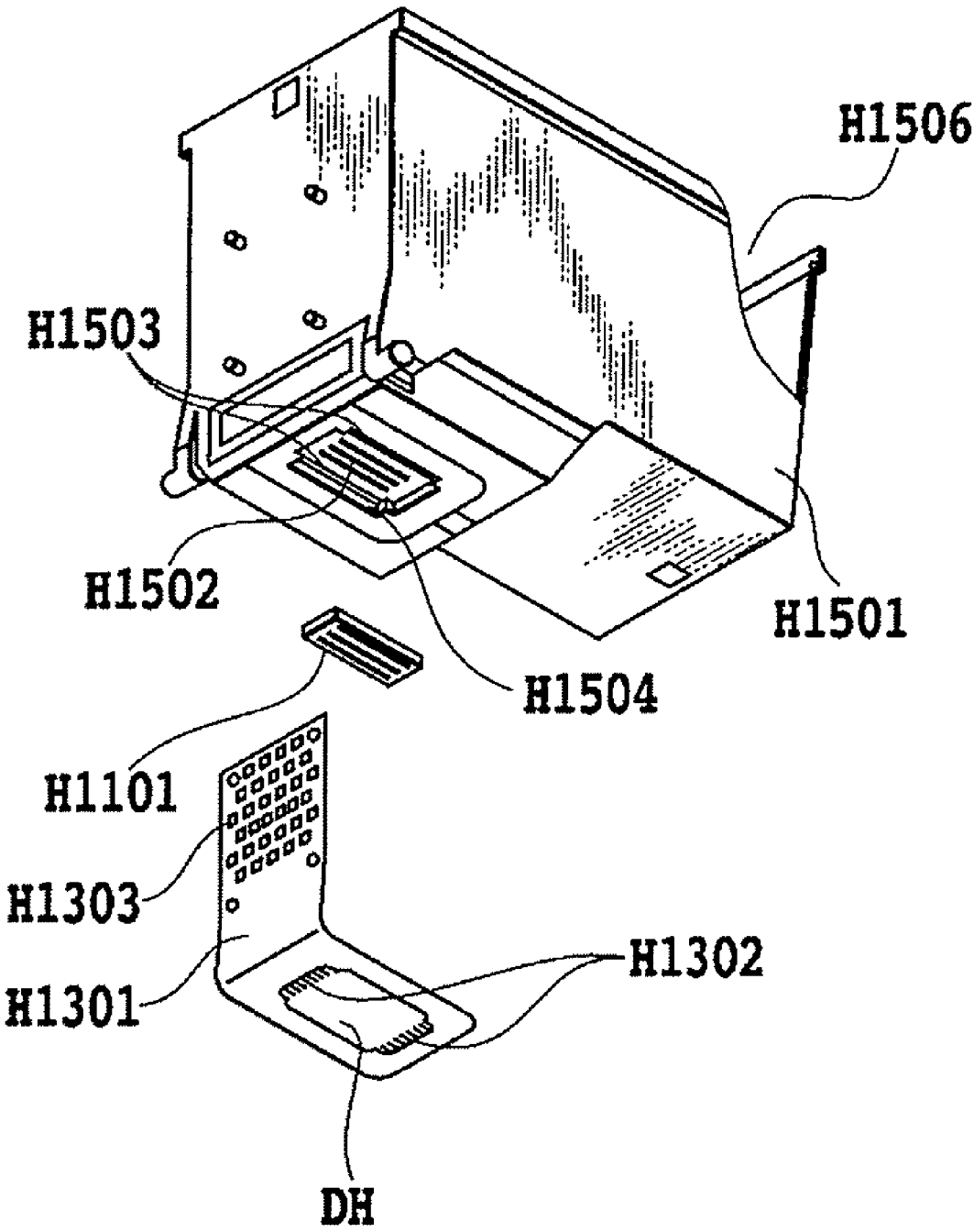
FIG. 1 is a schematic perspective view of an ink jet recording cartridge of the first embodiment in which the respective parts are disassembled.
Figure 2A:
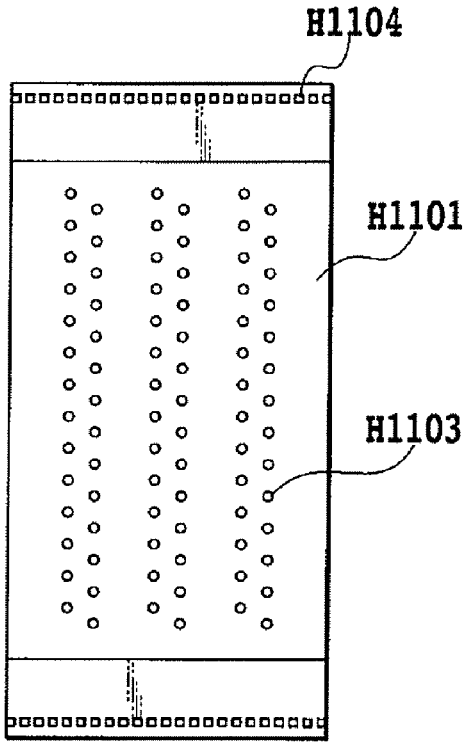
FIG. 2A is a plan view illustrating a top face of a recording element substrate.
Figure 2B:
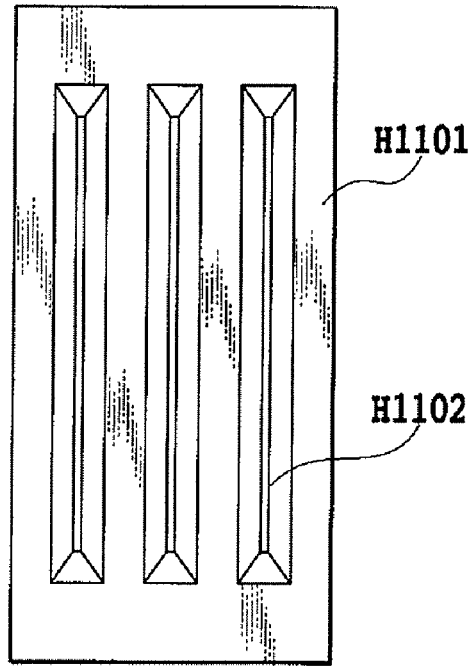
FIG. 2B is a plan view illustrating a back face of the recording element substrate.

FIG. 1 is a schematic perspective view illustrating an ink jet recording cartridge of this embodiment in which the respective parts are disassembled. FIG. 2A is a plan view showing a top face of a recording element substrate H1101. FIG. 2B illustrates a back face of the recording element substrate H1101. The recording element substrate H1101 includes, at one side of an Si substrate having a thickness of 0.62 mm, a plurality of energy generation elements for discharging ink (not shown) (hereinafter also may be referred to as heater) and an electric wiring (not shown) (e.g., Al) for supplying power to the respective energy generation elements that are formed by a film formation technique. The recording element substrate H1101 also includes a plurality of ink flow paths (not shown) provided to correspond to the respective heaters and a plurality of ink discharge openings H1103 that are formed by a photolithography technique. An ink supply opening H1102 for supplying ink to a plurality of ink flow paths is provided in a face opposite to the face including an ink discharge opening.

An electric wiring substrate H1301 includes: a device hole DH for attaching the recording element substrate H1101; an electrode terminal H1302 corresponding to an electrode H1104 of the recording element substrate H1101; and an external signal input terminal H1303 for receiving a control signal from a recording apparatus body. This external signal input terminal H1303 and the electrode terminal H1302 are connected by a copper foil wiring.

Figure 3:
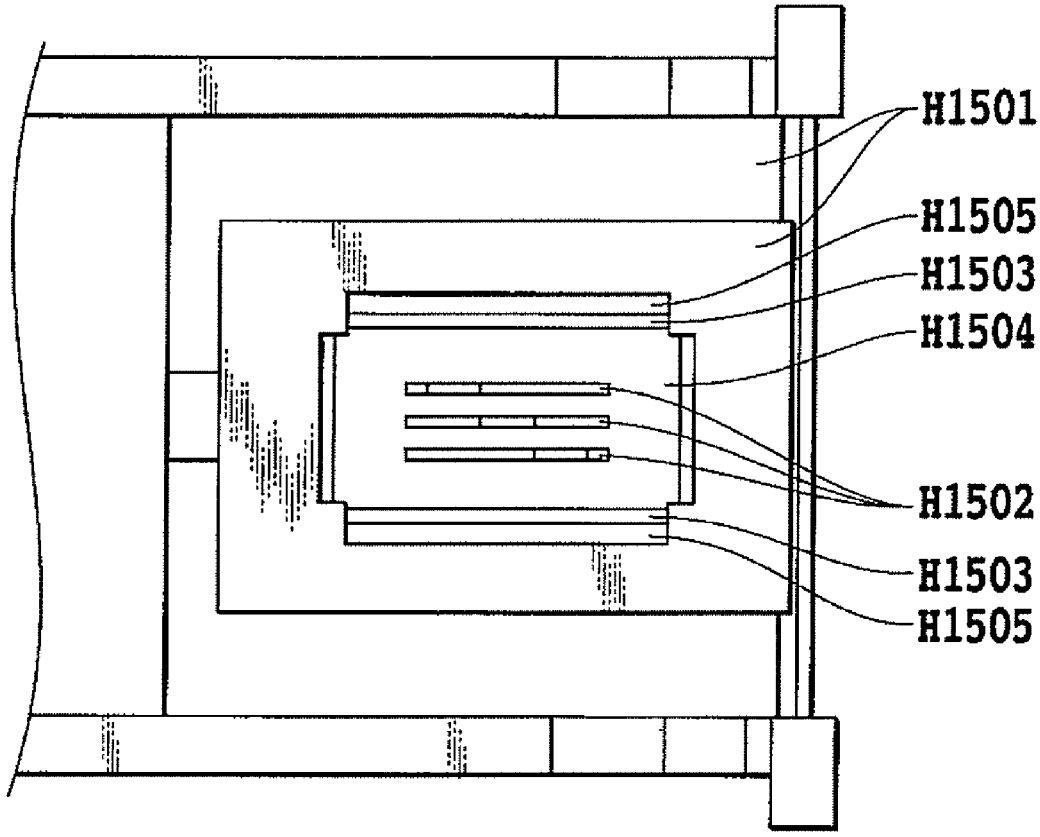
FIG. 3 is a plan view illustrating a support member having a salient of the first embodiment.

FIG. 3 is a plan view illustrating a support member H1501 having a salient H1503 of this embodiment. The support member H1501 is formed by a resin molding and uses in this embodiment resin material mixed with glass filler of 35% for improving the rigidity. This support member H1501 has an ink supply path H1502 from an ink storage section H1506 (see FIG. 5) and has, at a joint face H1504 with the recording element substrate, salients H1503 at both sides of the ink supply path H1502 that are provided so as to be in parallel with the ink supply path H1502.

Figure 4:
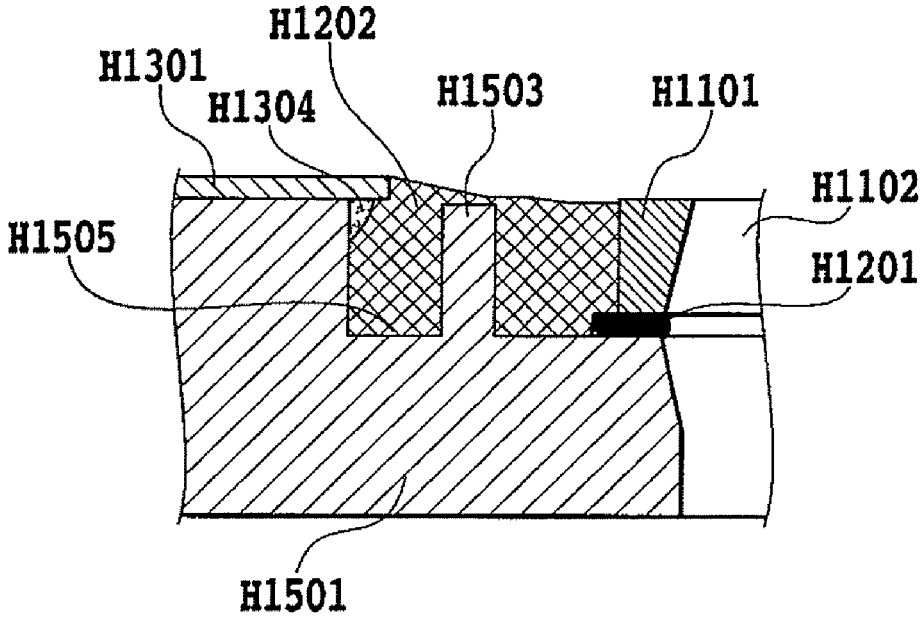
FIG. 4 is a cross-sectional view schematically illustrating a part of a joint section of the salient formed in the support member and the recording element substrate.

FIG. 4 is a cross-sectional view schematically illustrating a part of a joint section of the salients H1503 formed in the support member H1501 and the recording element substrate H1101. The recording element substrate H1101 is adhered to the support member H1501 by thermosetting adhesive agent H1201 and the recording element substrate H1101 is surrounded by the sealant H1202. The adhesive agent H1201 and the sealant H1202 desirably have a low curing temperature, cure in a short time, and have ink resistance. In this embodiment, the adhesive agent H1201 and the sealant H1202 are thermosetting resin mainly including epoxy resin. When this adhesive agent is used, an adhesion layer is provided to have a thickness of about 50 μm. The adhesive agent H1201 and the sealant H1202 used in this embodiment provide, when cured for one hour at 100 degrees, desired performances such as the above-described ink resistance and adhesiveness. The above adhesive agent and sealant H1202 are not limited to the above ones and may be other ones so long as they satisfy conditions required by the respective ink jet recording heads.

Figure 5:
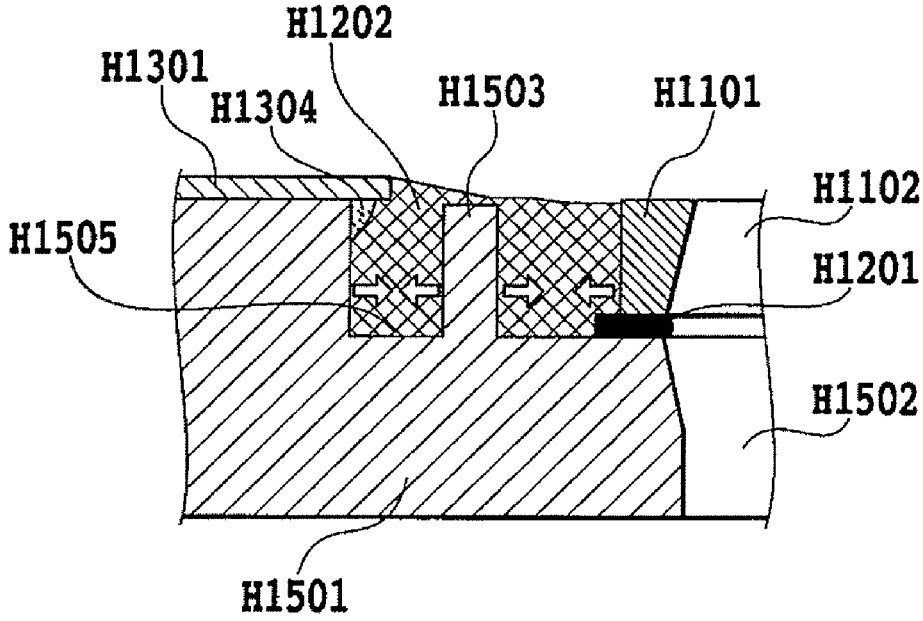
FIG. 5 illustrates stress caused when sealant in the support member including the salient cures and shrinks.

FIG. 5 illustrates stress caused when the sealant H1202 cures and shrinks in the support member H1501 including the salient H1503 of this embodiment. The existence of the salient H1503 as described above can reduce the volume to which the sealant H1202 is filled and thus the volume of filled sealant H1202 can be reduced. Consequently, the volume of the filled sealant H1202 adjacent to the recording element substrate H1101 is also reduced and the amount of the curing and shrinkage is also reduced. Thus, the stress applied to the recording element substrate H1101 can be reduced. Thus, an influence by the dislocation of the recording element substrate H1101 for example can be reduced to a level causing no problem.

In this embodiment, the salient H1503 is provided so as to face an end face in the longitudinal direction of the recording element substrate H1101. The reason is that, as can be seen from FIGS. 2A and 2B, the end face in the longitudinal direction of the recording element substrate H1101 is close to the ink supply opening and thus an external force to the end face in the longitudinal direction tends to cause the recording element substrate H1101 to deform or be broken. The salient also can be provided at a position in parallel with an end section that is not in the longitudinal direction. In this case, the stress applied to the recording element substrate H1101 also can be reduced to prevent the dislocation by the stress.

The interval between this salient H1503 and the recording element substrate H1101 is preferably minimized. The minimized interval can further reduce the stress applied to the recording element substrate H1101.

Next, the following section will describe how to prevent the adhesive agent H1304 from being protruded from a space between the support member H1501 and the electric wiring substrate H1301 when the adhesive agent H1304 is provided therebetween to fix the former and the latter.

Figure 6:
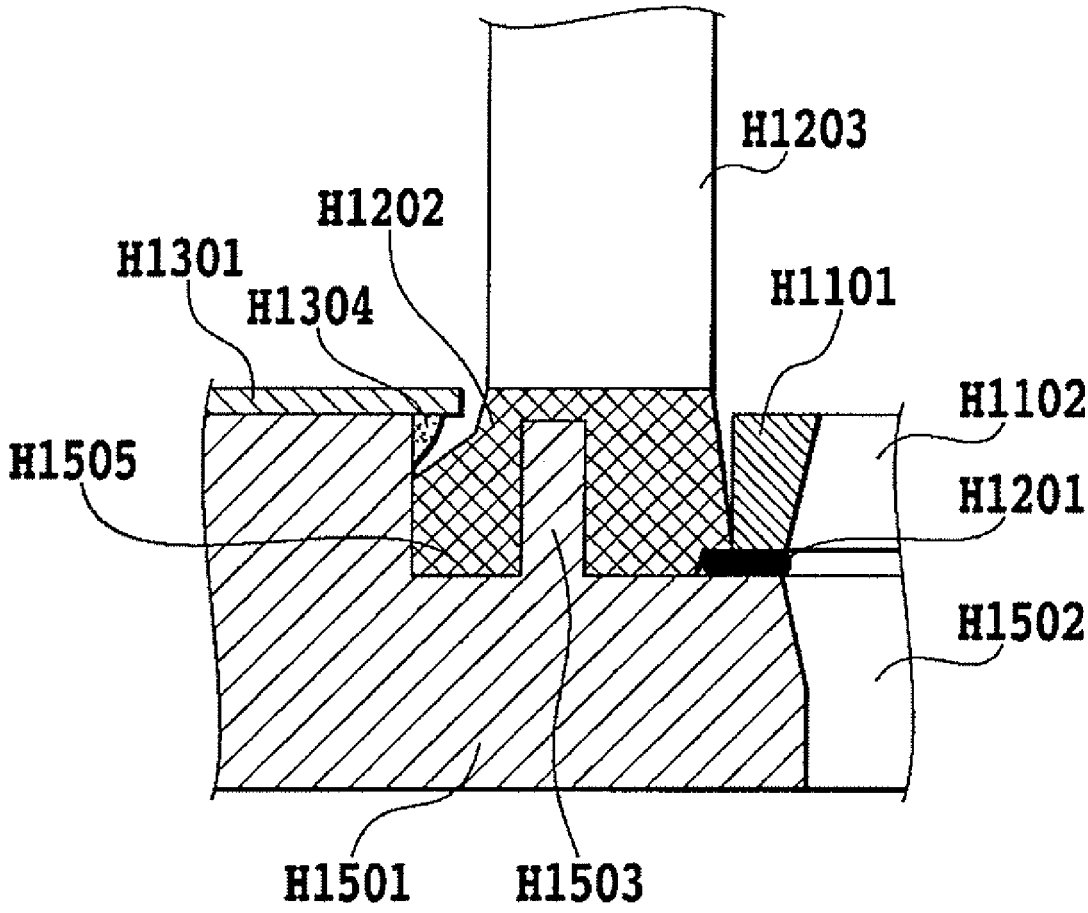
FIG. 6 illustrates sealant filled between the recording element substrate and the electric wiring substrate by a needle.

FIG. 6 illustrates sealant H1202 filled in the space between the recording element substrate H1101 and the electric wiring substrate H1301 by a needle H1203. The salient H1503 provided in a sealing coating region prevents the stress of the sealant from increasing. The electric wiring substrate H1301 has an opening section that is smaller than the opening section of the joint face of the electric wiring substrate H1301 of the support member H1501 to provide a space under the electric wiring substrate H1301 to store the adhesive agent H1304. This can prevent the adhesive agent H1304 from protruding to the upper face and side face of the electric wiring substrate H1301, thus preventing the adhesive agent H1304 to be attached to an adhesion tool used in the manufacture process.

Second Embodiment

The second embodiment in the present invention will be described with reference to the drawing.

Figure 7:
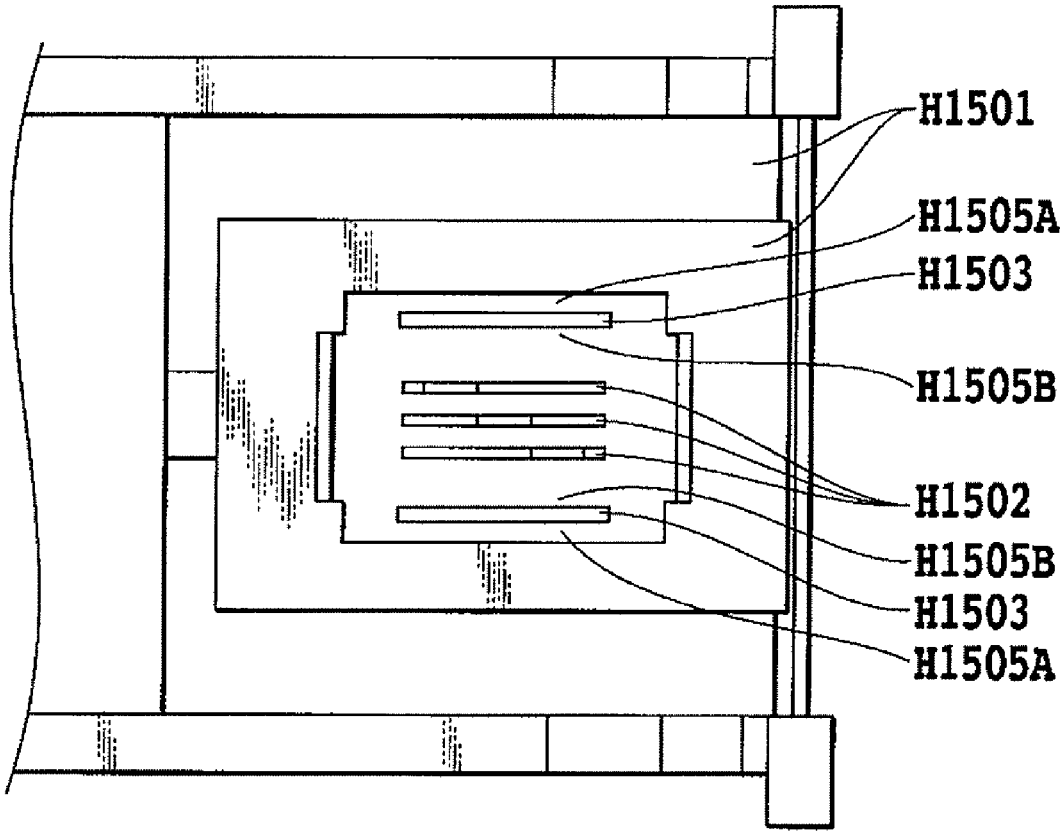
FIG. 7 is a plan view illustrating a support member and a salient of the second embodiment.

FIG. 7 is a plan view illustrating the support member H1501 and the salient H1503 of this embodiment.

The second embodiment has the same structure as that of the first embodiment except for the length of the salient H1503. The salient H1503 of the second embodiment is obtained by shortening both end sections in the longitudinal direction of the salient of the first embodiment to communicate a sealing groove H1505B adjacent to the recording element substrate H1101 with a sealing groove H1505A not adjacent to the recording element substrate H1101. The structure as described above allows filled sealant to pass both side ends of the salient H1503 to flow into both of the filling grooves H1505A and 1505B, thus providing an identical fluid level to sealant in both of the filling grooves. Then, the sealant H1202 is filled until the fluid level of sealant is at the same height as that of a face of the recording element substrate H101 having the discharge opening.

When the recording apparatus performs a recording operation, ink or dust for example attached to a discharge opening face is wiped so that the nozzle can always discharge ink in a correct manner. When a face formed by the sealant H1202 is different from a face having the discharge opening of the recording element substrate H1101 to prevent ink from being wiped, ink may be left on the sealant H1202 and has an increased viscosity. When the ink having an increased viscosity is transferred by the subsequent wiping operation to the discharge opening, the ink may clog the discharge opening. In order to avoid the defect as described above, the sealant H1202 is filled to the same height as that of the face of the recording element substrate H1101 having the discharge opening.

Although this embodiment shortened both side ends of the salient H1503, the above objective also can be achieved by shortening one side end or by eliminating the center part of the salient so as to divide the salient H1503 at the center. However, both filling grooves preferably communicate with each other at end sections in consideration of an influence by the stress on the recording element substrate H1101. Alternatively, instead of completely removing a part of the salient, the salient also may include a notch through which the sealant H1202 can flow.

Third Embodiment

Figure 8:
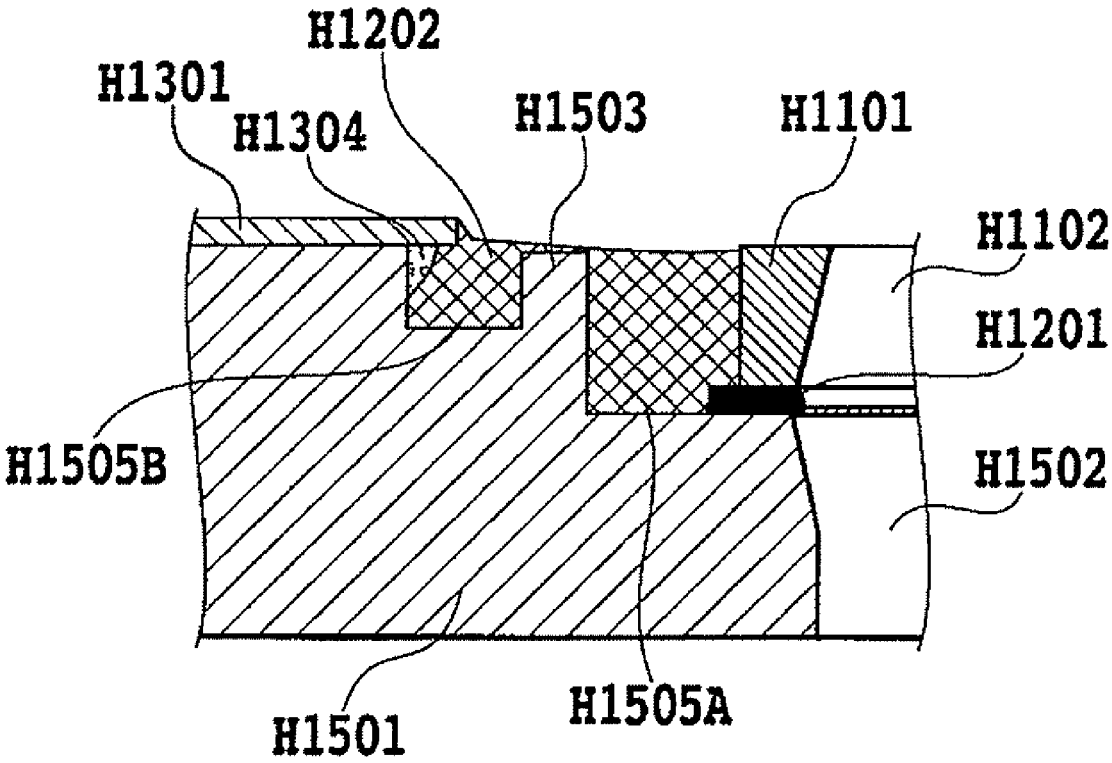
FIG. 8 is a plan view illustrating a support member and a salient of the third embodiment.
Figure 9B:
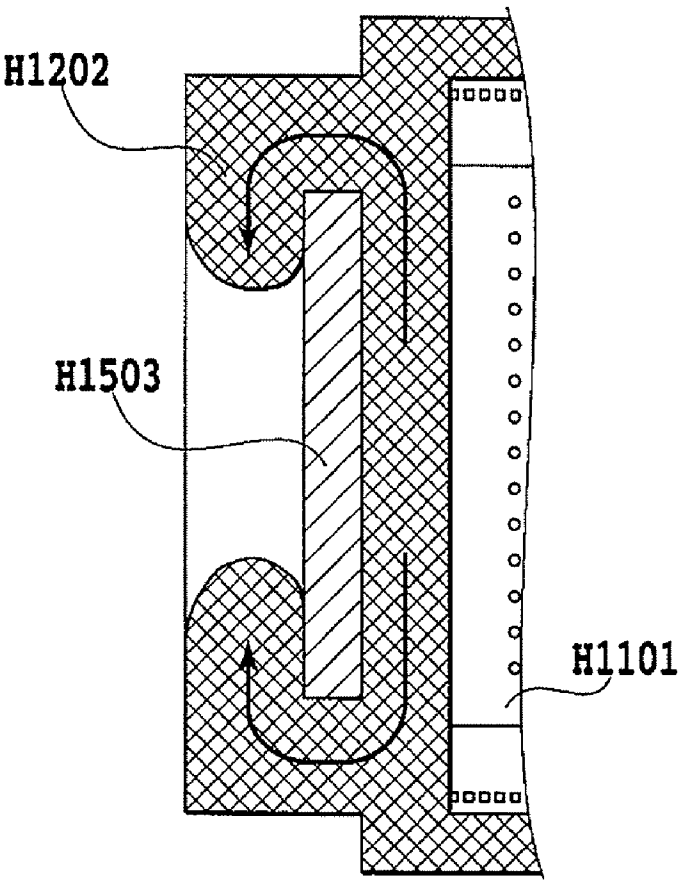
FIG. 9B is a top view illustrating sealant filled into the support member.
Figure 9A:
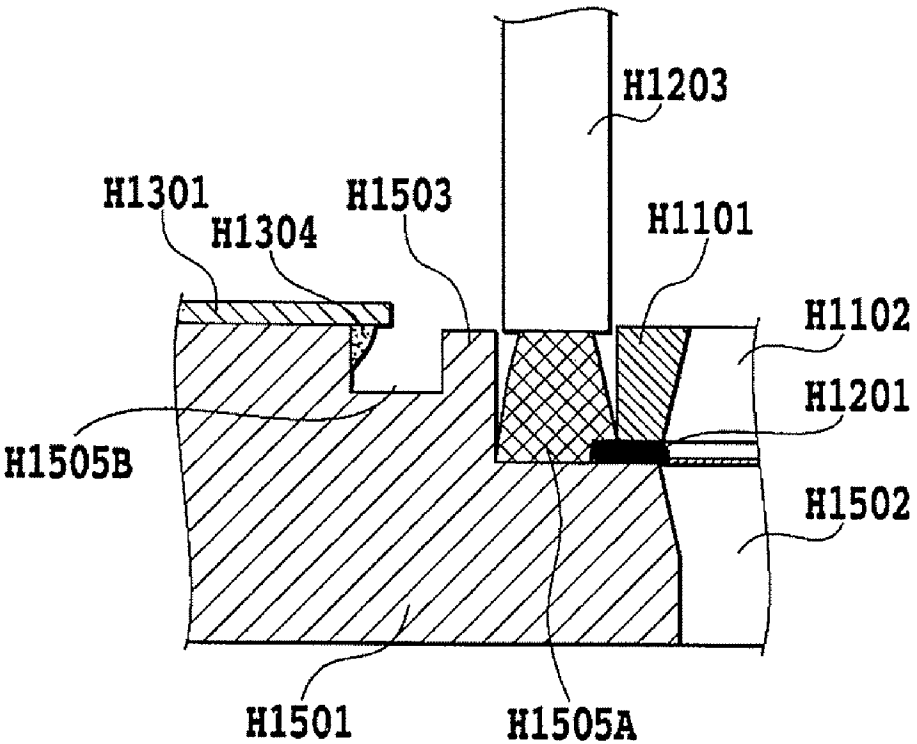
FIG. 9A is a longitudinal cross-sectional view illustrating sealant filled into a support member.
Figure 10:
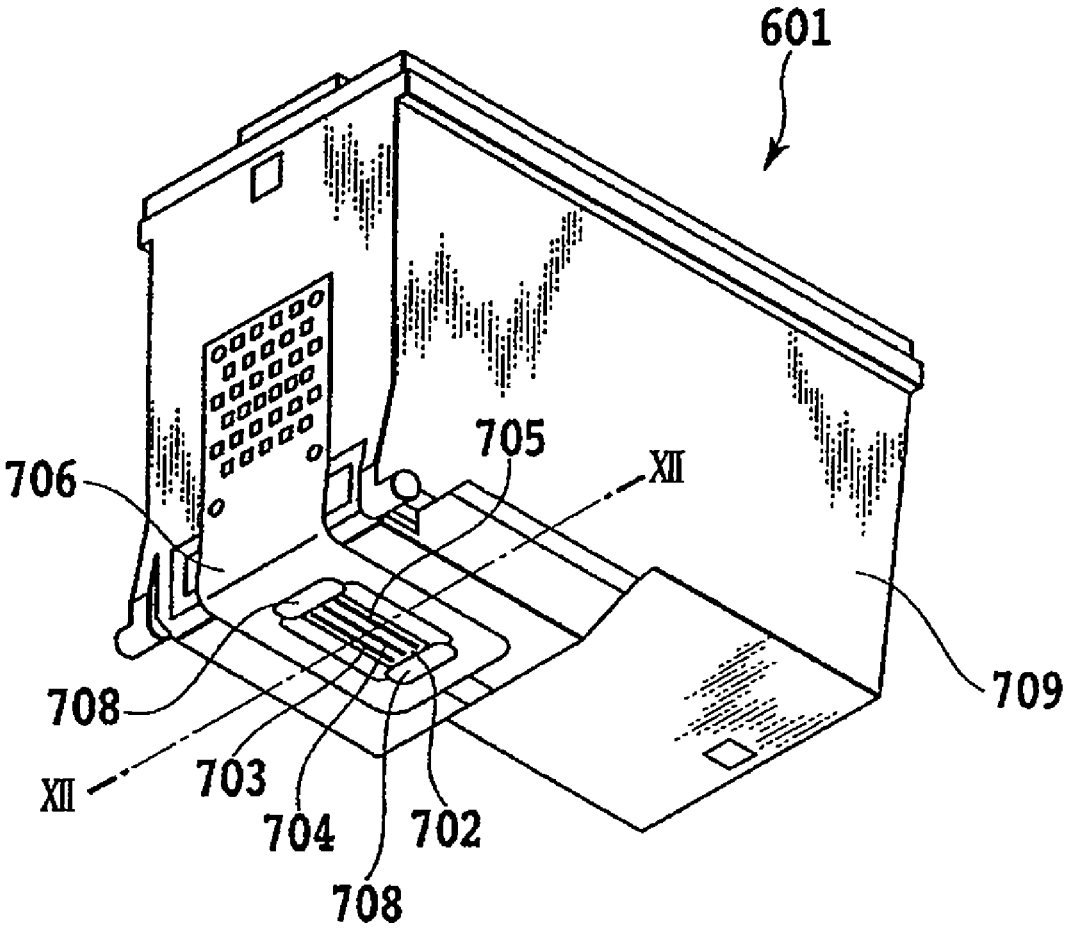
FIG.10 PRIOR ART
FIG. 10 is a perspective view illustrating a conventional ink jet recording cartridge.
Figure 11:
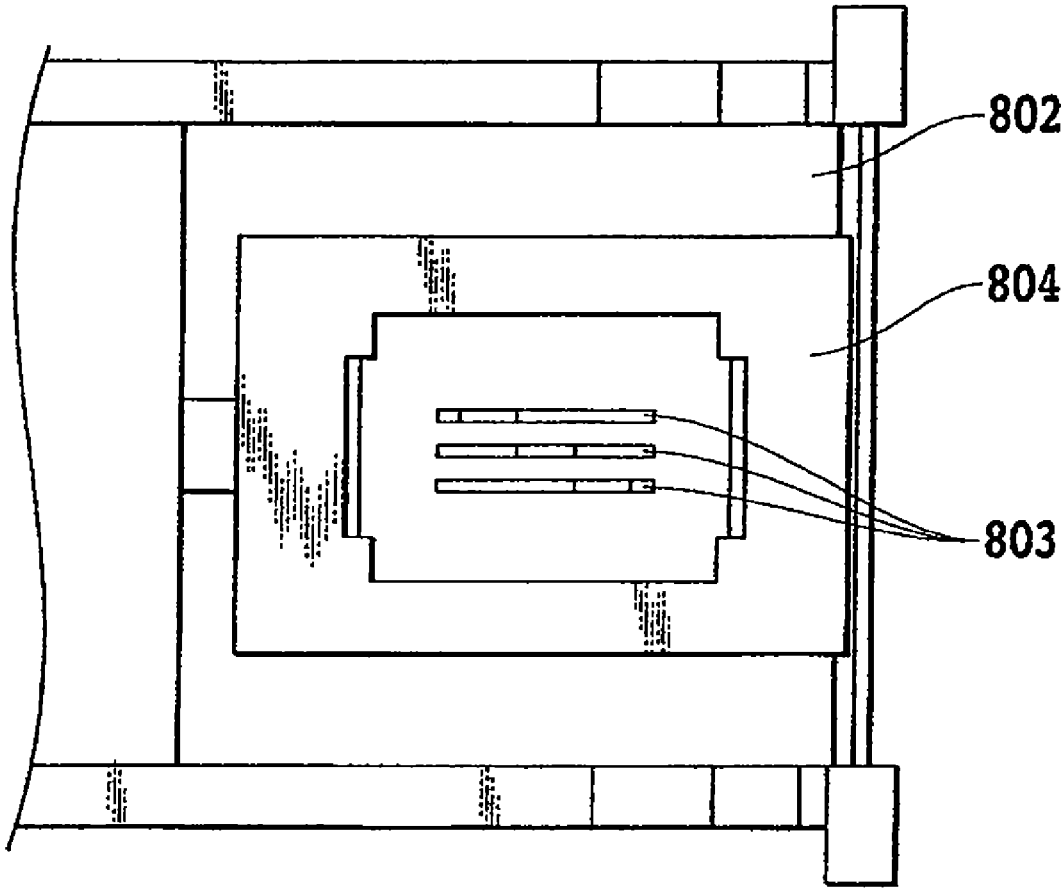
FIG.11 PRIOR ART
FIG. 11 is a plan view illustrating conventional support substrate and support plate.
Figure 12:
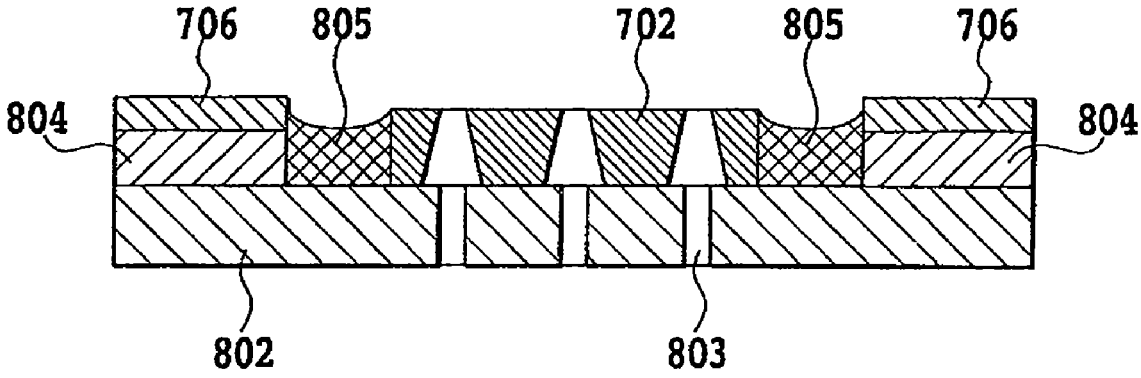
FIG.12 PRIOR ART
FIG. 12 is a cross-sectional view taken along a line C-C of FIG. 10.
Figure 13:
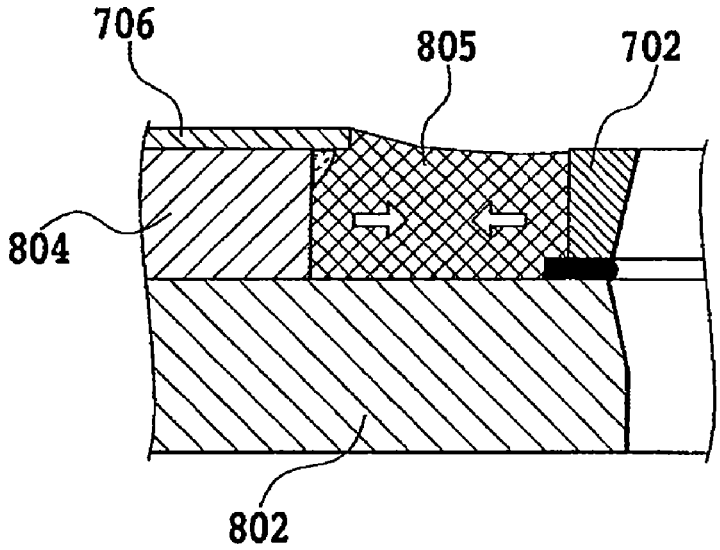
FIG.13 PRIOR ART
FIG. 13 illustrates how stress in the sealant is applied to the recording element substrate.

The third embodiment in the present invention will be described with reference to the drawings. FIG. 8 is a plan view illustrating the support member H1501 and the salient H1503 of the third embodiment. FIG. 9A is a longitudinal cross-sectional view illustrating sealant filled to the support member. FIG. 9B is a top view illustrating sealant filled to the support member. The third embodiment provides, as in the above-described embodiments, the salient H1503 to reduce the influence by the stress to the recording element substrate H1101. The third embodiment has the same structure as that of the second embodiment except that the filling groove H1505B in which the sealant H1202 is filled has a shallower depth. The existence of the filling groove H1505B having a shallower depth as in this embodiment can reduce the amount of filled sealant H1202 to reduce the shrinkage after the curing. This can reduce the stress applied to the recording element substrate H1101. Furthermore, the volume of the filling groove H1505B is designed to be higher than that of the adhesive agent H1304 when the adhesive agent H1304 protrudes. Thus, the adhesive agent H1304 is prevented from protruding to the upper face or side face of the electric wiring substrate.

The structure as described above can reduce an absolute amount of the sealant H1202 to reduce the stress to the recording element substrate H1101 when the sealant H1202 cures and shrinks. Thus, an ink jet recording head can be realized that can provide a recording operation with a high recording quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-136702, filed May 16, 2006, which is hereby incorporated by reference herein in its entirety.

What is claimed is:

1. An ink jet recording head comprising:

a recording element substrate including a discharge opening row for discharging ink; and a support substrate that has a support section for supporting the recording element substrate and that has a sealant filling region adjacent to the support section, wherein the filling region is divided, by a divider, into a filling region adjacent to the recording element substrate and a filling region away from the recording element substrate, and the divider has a height that is lower than a height of the recording element substrate supported by the support substrate.

2. The ink jet recording head according to claim 1, wherein the support substrate supports the recording element substrate so that the discharge opening row is in parallel with the divider.

3. The ink jet recording head according to claim 1, wherein the divider has a communication section providing communication between the filling region adjacent to the recording element substrate and the filling region away from the recording element substrate.

4. The ink jet recording head according to claim 3, wherein the communication section is provided at an end section of the divider.

5. The ink jet recording head according to claim 1, wherein the filling region away from the recording element substrate is filled with sealant in a smaller amount than that of sealant filled in the filling region adjacent to the recording element substrate.

6. An ink jet recording head comprising:

a recording element substrate including a discharge opening row for discharging ink; and a support substrate that has a support section for supporting the recording element substrate and that has a sealant filling region adjacent to the support section, wherein the filling region is divided, by a divider, into a filling region adjacent to the recording element substrate and a filling region away from the recording element substrate, and the divider has a communication section providing communication between the filling region adjacent to the recording element substrate and the filling region away from the recording element substrate.

7. The ink jet recording head according to claim 6, wherein the communication section is provided at an end section of the divider.

8. An ink jet recording head comprising:

a recording element substrate including a discharge opening row for discharging ink; and a support substrate that has a support section for supporting the recording element substrate and that has a sealant filling region adjacent to the support section, wherein the filling region is divided, by a divider, into a filling region adjacent to the recording element substrate and a filling region away from the recording element substrate, and the filling region away from the recording element substrate is filled with sealant in a smaller amount than that of sealant filled in the filling region adjacent to the recording element substrate.

* * * * *